US007181844B2

(12) United States Patent
Chen

(10) Patent No.: US 7,181,844 B2
(45) Date of Patent: Feb. 27, 2007

(54) METHOD FOR INCREASING STRUCTURAL STRENGTH OF SPOKES OF A BICYCLE OR A MOTORCYCLE

(75) Inventor: Wen-Hsuan Chen, Taipei (TW)

(73) Assignee: SHA DAR Accessories Co., Ltd., Taipei (TW)

( * ) Notice: Subject to any disclaimer, the term of this patent is extended or adjusted under 35 U.S.C. 154(b) by 275 days.

(21) Appl. No.: 10/603,619

(22) Filed: Jun. 26, 2003

(65) Prior Publication Data

US 2004/0261487 A1 Dec. 30, 2004

(51) Int. Cl.
*B21F 39/00* (2006.01)
*B60B 1/00* (2006.01)

(52) U.S. Cl. ..... 29/894.345; 301/104

(58) Field of Classification Search ..... 29/894.33, 29/894.345; 301/104; 72/306, 356
See application file for complete search history.

(56) References Cited

U.S. PATENT DOCUMENTS 1,660,319 A * 2/1928 Ash ..... 301/104
4,180,293 A * 12/1979 Norris et al. ..... 301/54
5,538,566 A * 7/1996 Gallagher, Jr. ..... 148/584

* cited by examiner

*Primary Examiner*—Lowell A. Larson
(74) *Attorney, Agent, or Firm*—Troxell Law Office, PLLC

(57) ABSTRACT

A method for increasing structural strength of spokes of a bicycle or a motorcycle, which adopts a mechanically processing measure to increase the structural strength of the bending section of the spoke. The spoke is many times compressed to process and harden the bending section of the spoke so as to enhance the metal strength (shearing strength) of the bending section. At the same time, the wire diameter of the spoke (cross-sectional area) is increased due to compression in accordance with the principle that shearing load=shearing strength×cross-sectional area. With least metal material and lower processing cost, the spoke can have highest structural strength.

3 Claims, 4 Drawing Sheets

METHOD FOR INCREASING STRUCTURAL STRENGTH OF SPOKES OF A BICYCLE OR A MOTORCYCLE

BACKGROUND OF THE INVENTION

The present invention is related to a method for increasing structural strength of spokes, and more particularly to a processing method which can increase the shear strength of the neck section and bending section of the spoke and increase the cross-sectional area thereof.

Taiwanese Patent Publication Nos. 261953, 317821, 385284, 398423, 4485851, 516517 and 511588 disclose structures for connecting the hub with the spokes of a wheel of a bicycle or a motorcycle. The above Patents provide measures for more conveniently assembling and disassembling the spokes. However, it is not considered that the spokes may be broken due to insufficient structural strength.

The spokes are mostly made of metal wire material such as carbon steel, stainless steel, titanium, alloy, etc. The selected wire material has good resilience and tensile strength. However, the shear strength of the metal is only about half the tensile strength. This is the major reason why the spoke always breaks first at the neck section. In a tension test of the spoke, the same result is obtained, that is, the neck section of the spoke is shorn (as shown in FIG. 1, wherein point B bears greatest shearing force).

To a wheel, in case one single spoke is broken, the other spokes will suffer uneven force and successively break. This will lead to danger to a rider.

Many trials have been made by manufacturers to reform the spoke structures (as Table 1). Mainly, the diameter of the wire is enlarged (or partially enlarged). This is effective. However, the consumption of material is increased and the weight of the product is increased. Therefore, this measure is not widely used. With respect to the spoke with partially enlarged diameter (such as double butted spoke and swaged spoke), the larger diameter wire is ground or swaged to partially reduce the diameter. The processing cost is high and the product still has considerable weight. In other words, it seems that it is impossible to satisfy all the requirements for low cost, light weight and high strength.

SUMMARY OF THE INVENTION

It is therefore a primary object of the present invention to provide a method for increasing structural strength of spokes of a bicycle or a motorcycle. The spoke is many times compressed to locally increase the density of the crystal lattice of the metal material and enhance the strength thereof so as to harden the bending section of the spoke and increase the shear strength thereof. Also, the diameter of the spoke is increased due to compression in accordance with the principle that shear load (kgf)=shear strength (kgf/mm$^2$)×cross-sectional area (mm$^2$). When the shear load of the spoke≧tensile strength of the wire material, the strength of the spoke will reach the maximum value (equal to the tensile strength of the wire material). That is, the neck section of the spoke is not shorn off, but the spoke main body is normally pulled off.

The present invention can be best understood through the following description and accompanying drawings wherein:

DETAILED DESCRIPTION OF THE PREFERRED EMBODIMENTS

The method for increasing structural strength of spokes of a bicycle or a motorcycle of the present invention adopts a mechanically processing measure for increasing the structural strength of the neck section 3 and bending section 2 of the spoke 1. The spoke processed by the method of the present invention is described in comparison with the conventional spoke as follows:

A spoke main body 1 made of stainless steel SS 304 by means of conventional technique is exemplified. The shearing strength is about 60 kgf/mm$^2$ and the tensile strength is about 110 kgf/mm$^2$. Therefore, in the case that the diameter of the spoke is 2.0 mm, then:

1. The maximum tension force which the spoke material can bear is:

$$110\ \text{kgf/mm}^2 \times [(2.0/2)^2 \times \pi]\ \text{mm}^2 = 345\ \text{kgf}$$

2. The maximum shearing force which the spoke can bear is: (Actually, the spoke is not normally shorn off. The cross-section is about 4.5~5.0.)

$$60\ \text{kgf/mm}^2 \times [4.5\sim5.0]\ \text{mm}^2 = 270\sim300\ \text{kgf}$$

It can be known from the above result that the tension force of the spoke can be up to 340 kg. However, in fact, the spoke will break at about 280 kg.

Figure 1:
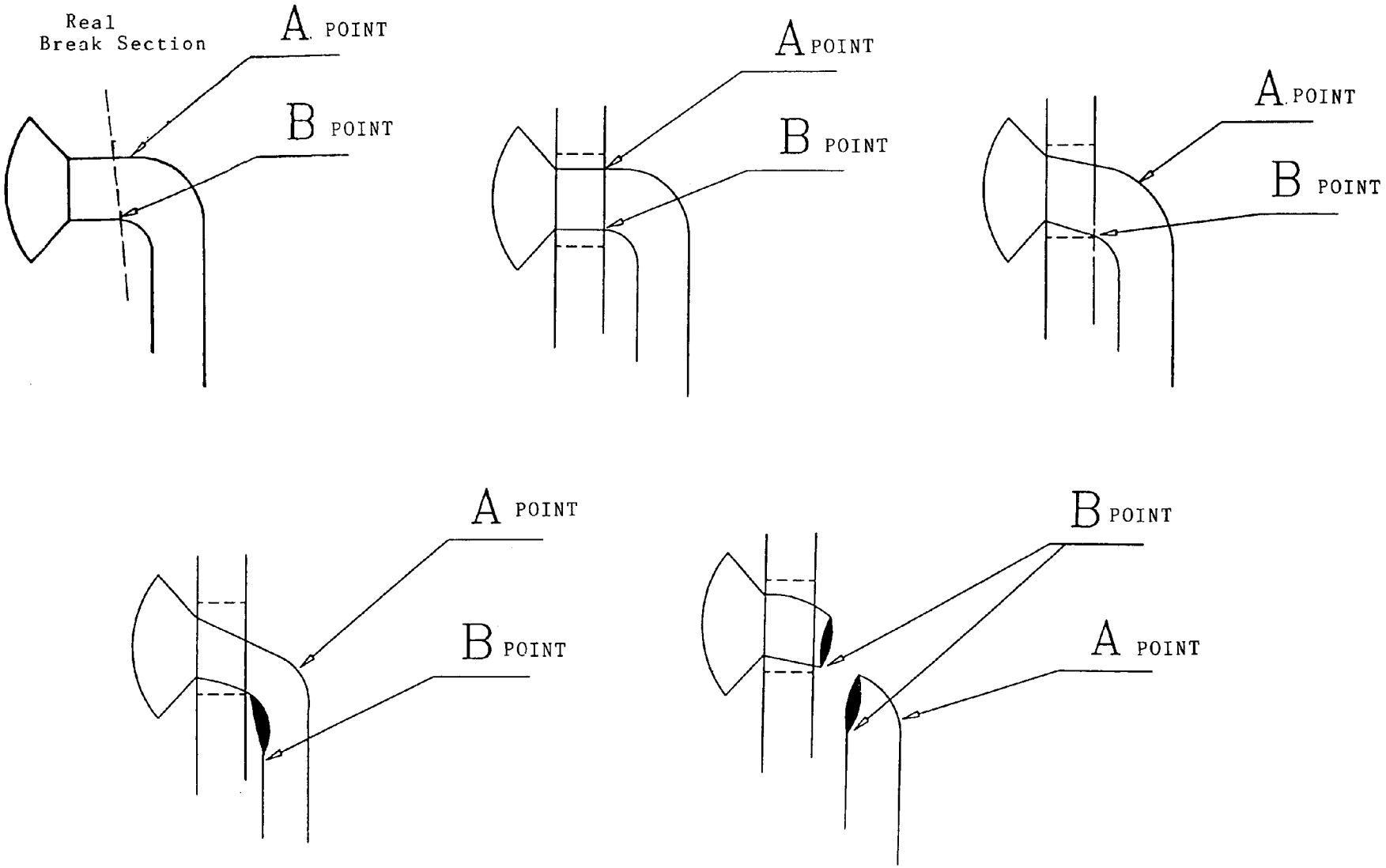
FIG. 1 shows the breakage of a conventional spoke.
Figure 2:
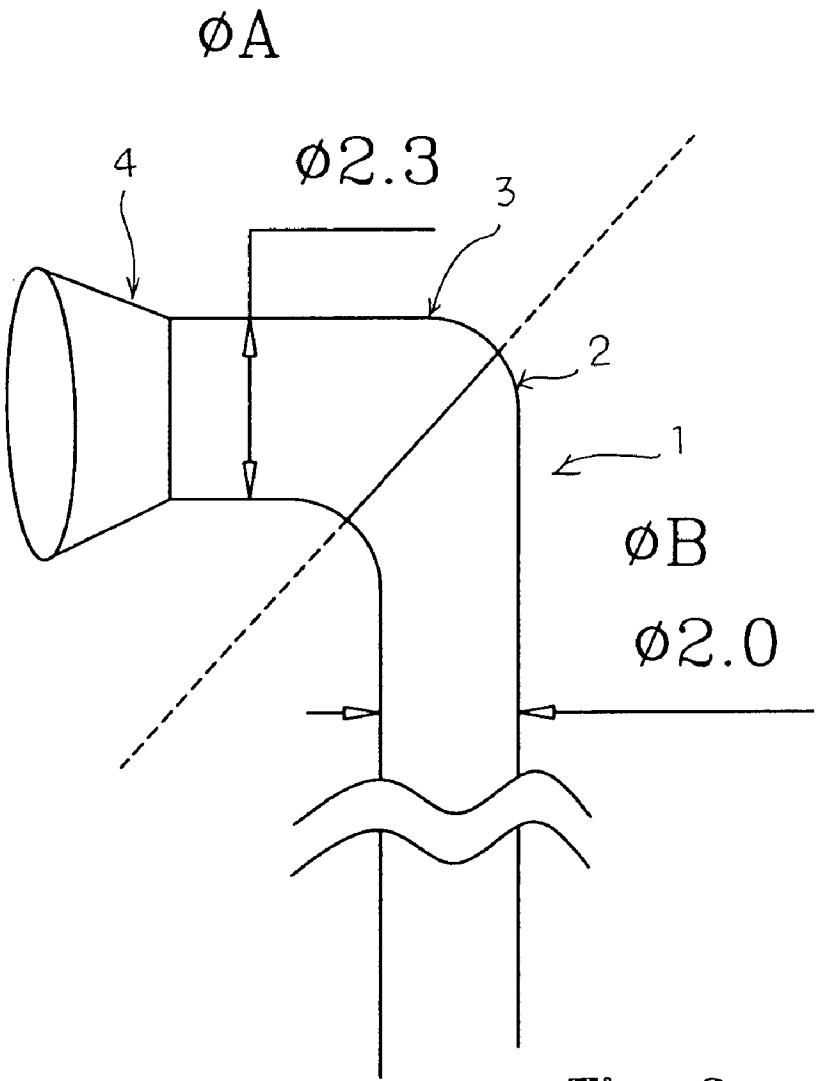
FIG. 2 shows the structure of the spoke made by the method of the present invention.

The spoke wire is three times compressed to naturally enlarge the diameter of the neck section 3 of the spoke main body 1 and a thickened section is formed at the bending section 2 as shown in FIG. 2. The original wire diameter ϕB (ϕ2.0) of the spoke main body 1 will be changed into ϕA (ϕ2.3). The ratio is about 1.15 increased. After such processed, the tensile strength and shear strength of this section are both increased. Accordingly, almost without increasing the amount of the material, the structural strength of the spoke is increased.

The processed spoke is tested as shown in Table 2 made by Taiwan Technology Co., Ltd.

Figure 3:
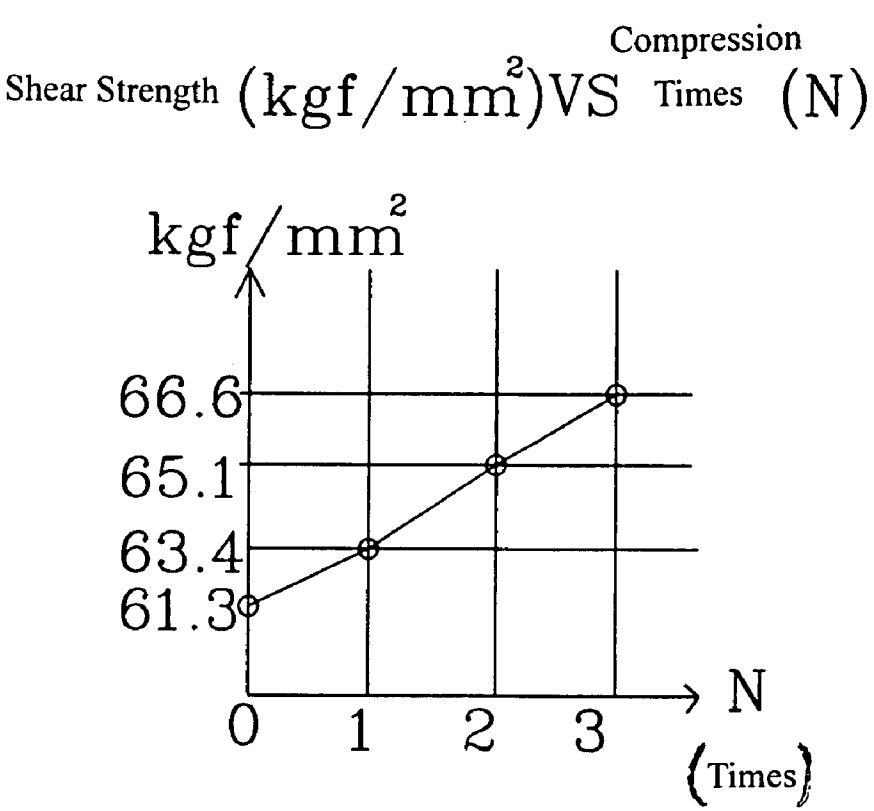
FIG. 3 is a curve diagram of the shearing force versus the number of times of compression of the spoke of the present invention.
Figure 3:
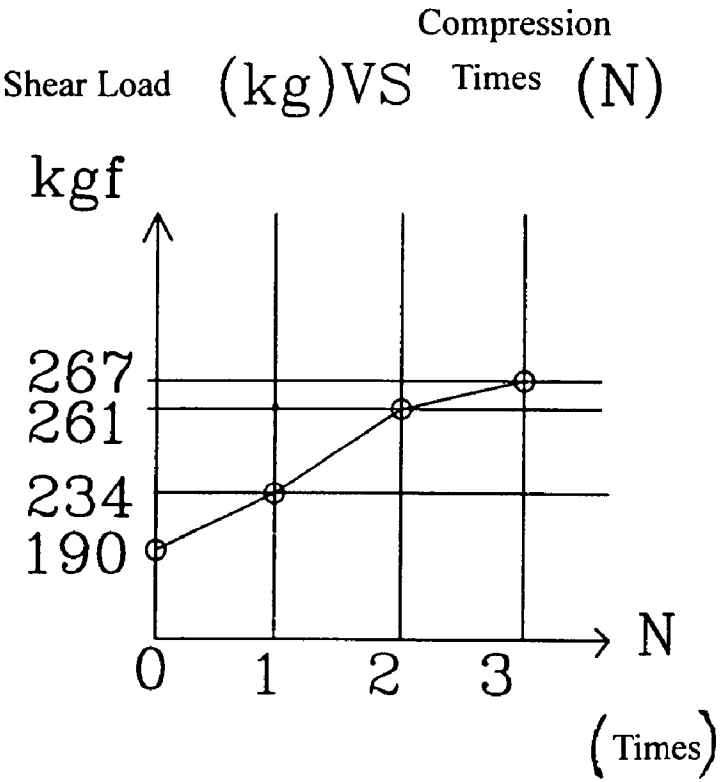
Figure 4:
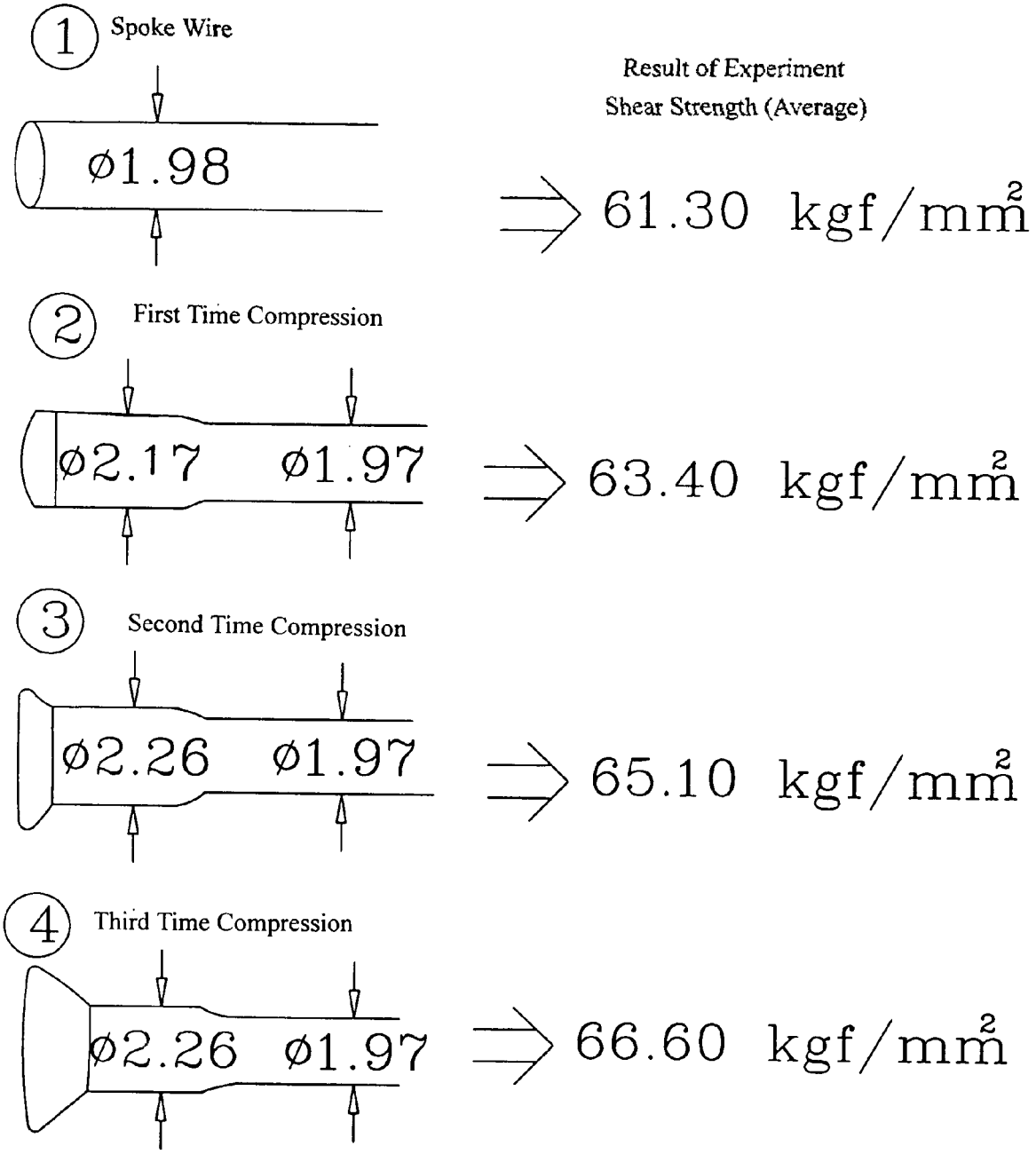
FIG. 4 shows that the spoke is gradually compressed and formed by the method of the present invention.

It can be known from Table 2 that during the three times of compression, the diameter of the spoke is changed as shown in FIG. 3. The result is as shown in FIG. 4. The final result of the spoke is as follows:

The actual shearing load is enhanced:

$$(267-190)/190 = 40.5\%$$

The actual cross-sectional area is enhanced:

$$\frac{\pi\,[(2.264)^2 - (1.98)^2]/4}{\pi(1.98)^2/4} = 30.3\%$$

The actual shearing strength is enhanced:

$$(66.6-61.3)/61.3 = 8.65\%$$

The final product is tested with respect to tensile strength. The breaking place is at the spoke main body. The strength is 345 kgf. (The bending section is unbroken.)

It can be known from the above that the conventional spoke can be processed by means of the method of the present invention to achieve a spoke structure made of least material, while having highest strength. Therefore, the structural strength of the spoke is increased.

The present invention adopts a mechanically processing measure in which spoke 1 is many times compressed so that the diameter of specific sections of the spoke 1, such as the bending section 2 and the neck section 3, are naturally increased almost without changing the amount of the used material. At the same time, the tensile strength and shearing strength of the bending section 2 and the neck section 3 are increased.

The above embodiments are only used to illustrate the present invention, not intended to limit the scope thereof. Many modifications of the above embodiments can be made without departing from the spirit of the present invention.

TABLE 1

Comparison in all kinds of Spokes (Tension, Weight, Cost)
(Based upon the same material)

| Type | Charts | Pulling Strength | Weight | Cost |
|---|---|---|---|---|
| Reformed spoke | 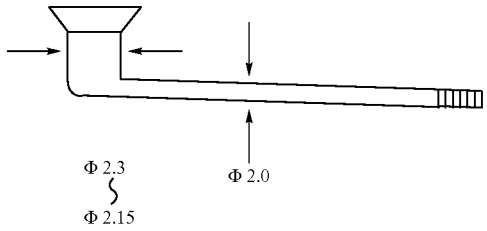  | A High brake point | A Lightest | A Lowercost |
| Plain spoke | 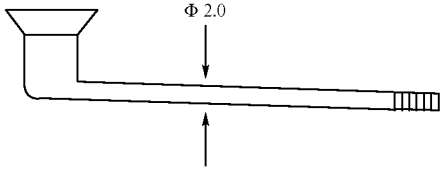  | C | A | $A^+$ |
| Plain spoke | 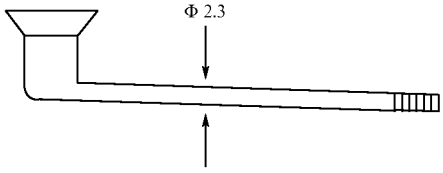  | $A^+$ | D | B |
| Swaged thread spoke | 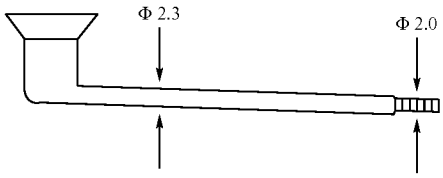  | A | C | C |
| Swaged spoke | 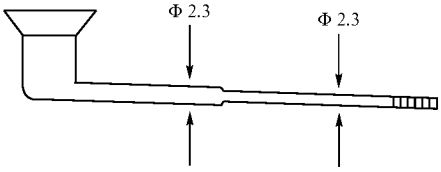  | A | $B^+$ | D |
| Double Butted spoke | 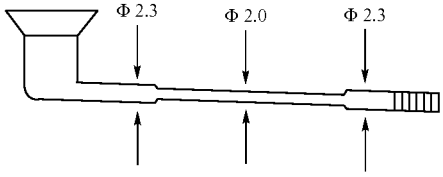  | A | B | D |

TABLE 2

| TEST SAMPLE | Shear Area $mm^2$ | Shear Load Kgf | Shear Strenth $Kgf/mm^2$ |
|---|---|---|---|
| Reformed Spoke/Wire | 3.1 | 190.1 | 61.3 |
| Reformed Spoke/First Comporesssion | 3.7 | 234.7 | 63.4 |
| Reformed Spoke/Second Comporession | 4.0 | 261.2 | 65.1 |
| Reformed Spoke/Third Comporession | 4.0 | 267.1 | 66.6 |

What is claimed is:

1. A method for increasing a structural strength of a spoke, which comprises the steps of:

a) compressing a main body of the spoke increasing cross-sectional areas of a bending section and a neck section utilizing a mechanical processing device to form a processed bending section and a processed neck section, the processed bending section and the processed neck section have a strength greater than a strength of the bending section and the neck section; and b) repeating the compressing step a) at least three times to produce a finished neck section having a predetermined neck section cross-sectional area and a finished bending section having a predetermined bending section cross-sectional area, wherein, after the compressing step a) has been performed a third time, the finished neck section has a diameter 1.15 times larger than an original diameter of the neck section.

2. The method according to claim 1, wherein the spoke is made of a material selected from a group consisting of carbon steel, stainless steel, titanium, and alloy steel.

3. The method according to claim 1, wherein the strength of the processed bending section and the processed neck section increases each time the compressing step a) is repeated.

* * * * *